US006397768B1

(12) United States Patent
Dasher et al.

(10) Patent No.: US 6,397,768 B1
(45) Date of Patent: Jun. 4, 2002

(54) MATTRESS BORDER PRODUCTION SYSTEM

(76) Inventors: Preston B. Dasher, 1204 Bailing Rd., Lawrenceville, GA (US) 30043; Elvin C. Price, 1570 Ewing Chapel Rd., Dacula, GA (US) 30019; John S. Chamlee, 2490 Cedars Rd., Lawrenceville, GA (US) 30045; Clifton R. Howell, 4555 Creek Bluff Rd., Sugar Hill, GA (US) 30518; Van H. Nguyen, 1220 Arthur Ct., Lawrenceville, GA (US) 30045; Danny V. Murphy, 165 Sweet Auburn La., Dacula, GA (US) 30019; Ezekiel T. Hill, 1414 Lakemont Dr., Grayson, GA (US) 30017

( * ) Notice: Subject to any disclaimer, the term of this patent is extended or adjusted under 35 U.S.C. 154(b) by 0 days.

(21) Appl. No.: 09/812,137

(22) Filed: Mar. 19, 2001

Related U.S. Application Data

(63) Continuation-in-part of application No. 09/479,447, filed on Jan. 11, 2001, now Pat. No. 6,202,579.

(51) Int. Cl.[7] ..... D05B 11/00; D05B 35/06

(52) U.S. Cl. ..... 112/2.11; 112/470.36

(58) Field of Search ..... 112/2.1, 147, 152, 112/470.33, 470.36, 307, 475.06, 475.07, 475.08; 229/87.01; 206/812, 821, 83.5; 24/17 B, 17 R; 53/545, 203

(56) References Cited

U.S. PATENT DOCUMENTS

| | | | | | |
|---|---|---|---|---|---|
| 4,787,325 | A | * | 11/1988 | Black et al. | 112/470.36 |
| 5,570,648 | A | * | 11/1996 | Burt et al. | 112/305 |
| 5,596,939 | A | * | 1/1997 | LaVelle et al. | 112/130 |
| 5,664,508 | A | * | 9/1997 | Mulcahey et al. | 112/2.1 |
| 5,983,814 | A | * | 11/1999 | Block | 112/2.1 |
| 6,000,591 | A | * | 12/1999 | Alexander | 211/113 |
| 6,026,957 | A | * | 2/2000 | Bauer et al. | 206/494 |

* cited by examiner

*Primary Examiner*—Ismael Izaguirre
(74) *Attorney, Agent, or Firm*—Arter & Hadden LLP

(57) ABSTRACT

A machine for automatically producing a mattress border with handles sewn to the border material. Border material is pre-fed from a selected spool, screened for splice avoidance and measured. Handle material is fed from a selected spool mounted in a multiple handle material spool magazine mounted on rails, fed into a handle folding assembly, and cut to length. Ends of the handle material are folded under by the handle folding assembly and the handle then transferred in a folded condition from the handle folding assembly to a correct position on the border material. A double frame handle press holds each folded end of the handle material in place as each end is maneuvered under a sewing head needle to apply a stitch pattern to secure the folded ends to the border material. The double frame handle press is translated separately from the carriage assembly which travels in the sew pattern, to position the other end of the handle under the sewing needle.

19 Claims, 13 Drawing Sheets

MATTRESS BORDER PRODUCTION SYSTEM

RELATED APPLICATIONS

This application is a continuation-in-part of U.S. application Ser. No. 09/479,447, filed Jan. 11, 2001, now U.S. Pat. No. 6,202,579.

FIELD OF THE INVENTION

The invention pertains generally to automated sewing operations and, more particularly, to automated sewing and mattress component product operations.

BACKGROUND OF THE INVENTION

Mattresses have traditionally been provided with handles on the vertical side panel or "border" material which covers the side of the mattress, between the top and bottom surfaces. Such border handles are most commonly in the form of a rope or elastic cord, with the ends extending through grommets in the border material and knotted or stapled inside the mattress. The assembly of such handles is labor intensive, requiring measurement for grommet placement, operation of a grommet press, and insertion and securement of each end of the handle through the grommet.

More recently, handles made of a strip of fabric have been sewn to the border material. This requires that each end of the handle is secured by a substantial stitch pattern, such as a box with an X stitch pattern inside the box, in order to give the attachment sufficient strength. To sew a multi-dimensional pattern requires that the mattress border, with the handle in place on top of it, be moved in different directions on a platform under the sewing needle. Also, the ends of the handle can be folded under to double the thickness of material and further increase the strength of the handle. This can be done by hand, or by clamping the handle (with the ends folded) against the border and moving the clamped pieces by an automated carriage assembly, by use of an "X-Y" sewing machine. For example, the Mitsubishi PLK series sewing machines are equipped with an X-Y translation carriage mechanism, to which a clamping assembly can be attached, as described in U.S. Pat. Nos. 5,520,129 and 5,738,029. The '029 patent describes certain modifications to the stock Mitsubishi carriage assembly to increase the X-direction range of motion of the entire assembly, to position an opposite end of a mattress handle under the sewing head. This requires a large amount of repeated mechanical motion for high speed continuous production. Also, the '029 patent requires that each handle be folded and inserted into a clamp by hand, and that the border material be advanced by hand to position it for attachment of the next handle.

Other machines have been developed which automatically fold material prior to placing it in position on another piece of material for sewing. This is common, for example, in the automated attachment of belt loops, such as described in U.S. Pat. Nos. 3,699,907; 4,385,571 and 4,393,800. Although such machines are functional, they do not represent the most efficient and flexible means of mass producing sewn articles, or to produce a specific component in its entirety such as a mattress border.

SUMMARY OF THE INVENTION

The present invention overcomes these and other disadvantages of the prior art, by providing an automated machine for producing measured and cut mattress borders with end folded handles attached by sewing. In accordance with one aspect of the invention, there is provided a machine for automatically producing a mattress border with at least one handle sewn to the mattress border material. The machine includes a spool of border material; a border material feed mechanism for feeding border material from the spool of border material; a spool of handle material; a handle material feed mechanism operative to feed and cut handle material from the spool of handle material; a handle cutter for cutting a handle from the handle material; a sewing platform over which the border material passes; a handle folder assembly for folding ends of a handle under prior to placement of a folded handle on the border material at a position where the folded handle is to be sewn to the border material, the handle folder assembly having: a folding plate having first and second ends; a folding blade at each end of the folding plate, each folding blade operative to descend down upon an end of a handle which extends beyond an end of the folding plate, and further operative to move underneath an end of the folding plate to fold the end of the handle under the folding plate; a clamp fork positioned over each end of the folding blade and operative to be lowered upon a folded end of the handle, and operative to move the handle off of the folding blade and on to the border material; a double frame handle press operative to frame and compress each folded end of the handle material positioned on the border material, and to move each folded end of the handle upon the sewing platform and under a sewing needle in a sewing pattern which attaches the folded ends of the handle to the border material.

In accordance with another aspect of the invention, there is provided a machine for automatically sewing ends of a fabric handle to a mattress border, the machine having: a supply of border material; a supply of handle material; a handle folding assembly; a double frame handle press; a sewing platform, and a sewing head; drive rollers for drawing border material from the border material supply onto the sewing platform; drive rollers for drawing handle material from the handle material supply into the handle folding assembly; a handle material cutter for cutting a length of handle material from the handle material supply; the handle folding assembly having: a folding plate with first and second ends about which ends of a piece of handle material are folded; folding blades which are actuated to descend down upon the ends of the handle material and under the folding blade; folded handle transfer arms which transfer the handle material with the ends folded from the folding blade on to the border material on the sewing platform; and a double frame handle press which compresses down upon the handle on the border material.

And in accordance with still another aspect of the invention, there is provided a material folding device operative to fold a portion of a piece of material under a plate and to transfer material in a folded condition, the device having: a folding plate having a planar surface for supporting at least a portion of material to be folded, and ends beyond which a piece of material may extend; at least one material holding device above the folding plate, the material holding device being controllable to extend downward into contact with a piece of material on the folding plate, and at least one folding blade operative to extend downward past an end of the folding plate and to extend under an end of the folding plate.

And in accordance with another aspect of the invention, there are provided various post-production modules in connection with the machinery of the system, including a folding module which folds a mattress border into a bundle;

a closing module which sews together the ends of the border material to form a closed loop border ready for attachment to a mattress; a printing module operative to apply indicia to each border; a wrapping module operative to wrap each completed border in a packaging material for inventory storage or transfer, and a stacking module for presenting completed and packaged borders for subsequent handling. A vent installation module is also described in connection with the machinery of the invention.

Flexible process control of each aspect of the system enables selective end-product variation, such as the number and location of handles attached to the border material, and the number and location of vents installed.

These and other novel aspects of the invention are described with specific reference to the accompanying Figures.

DETAILED DESCRIPTION OF THE INVENTION

Figure 1:
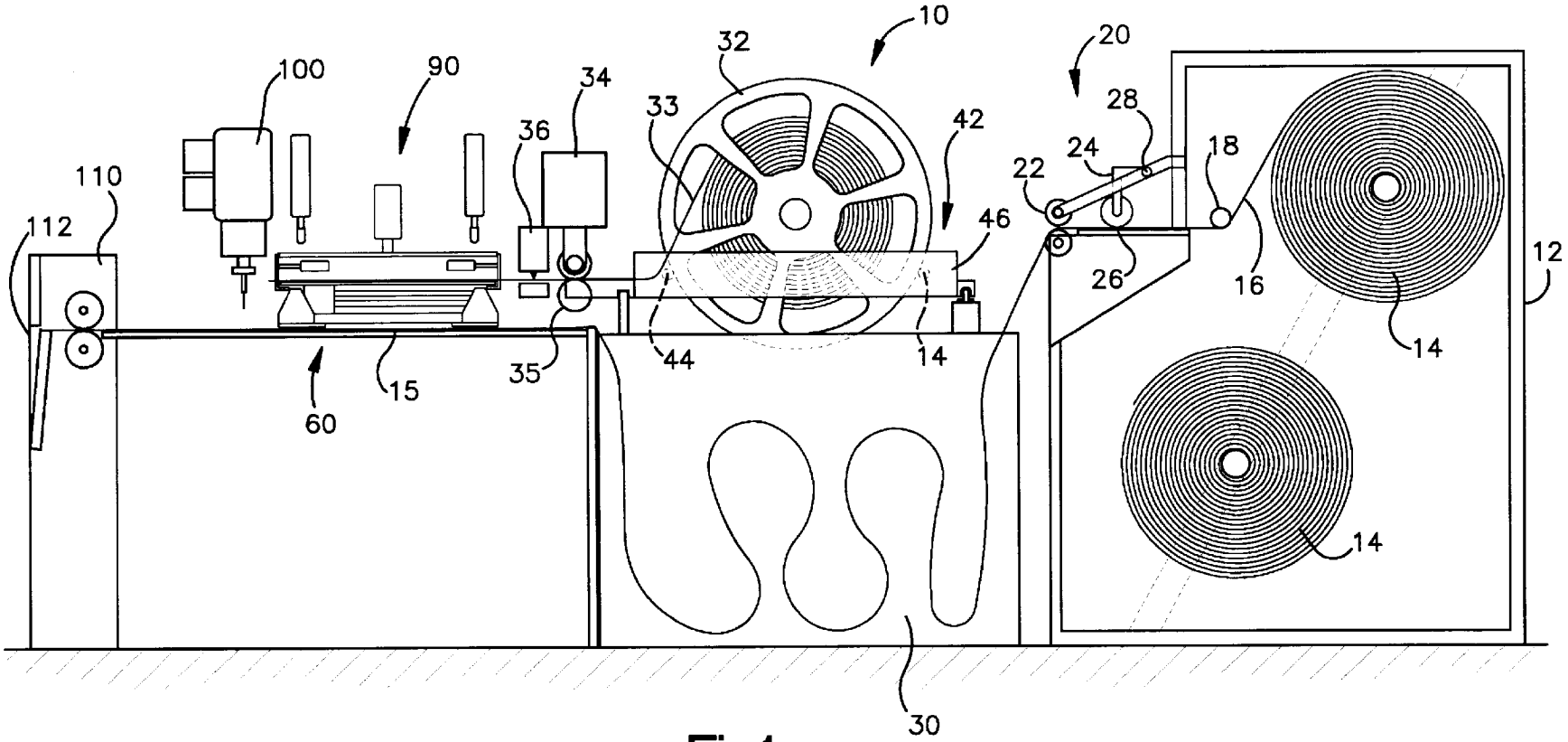
FIG. 1 is a schematic side elevation of an automated mattress border production machine constructed in accordance with the present invention.

An exemplary description of the invention follows, where it is understood that like reference numerals refer to like elements. FIG. 1 shows schematically at 10 an automated apparatus for producing mattress borders with folded and sewn handles. The apparatus 10 automatically performs the primary functions of:

1) measuring a length of border material sufficient for the size mattress to be made;

2) feeding and cutting material from a selected handle material spool to form a handle;

3) folding the ends of the handle material under and placing and holding the handle material in a folded condition at a proper location on the border material;

4) sewing the folded ends of the handle material to the border material;

5) advancing the border material to repeat the process for attachment of all handles, and 6) cutting the border material to a proper length to form a mattress border.

As depicted in FIG. 1, the process moves generally from right to left. A border material spool rack 12 is used to support one or more spools 14 of border material, which as known in the industry is typically quilted material or "ticking" of upholstery grade with a fill or foam and a backing layer. The rack 12 configured with multiple spools 14 provides a flexible border manufacturing system whereby borders of differing colors and styles can be produced without reloading or stocking the machine. The rack 12 is designed to rotatably mount multiple spools 14 in general alignment with a sewing lane of the machine, i.e., along a central axis about which the operative components are aligned. The spools 14 may be threaded into the apparatus 10 from a stationary position, or the spools 14 may be indexably mounted on the rack 12 to slide in and out of a feed position. Alternatively, the spools 14 can be mounted on a vertically mounted carousel which can be indexed to the selected spool.

From the spool 14, border material 16 is threaded under a turning or pin 18 into a border material pre-feeder indicated generally at 20, which includes pre-feed drive rollers 22 for advancing the border material from the spool. An encoder 24 is used to measure the length of the advanced material. The- encoder 24 includes a wheel that measures border material linear length by counting the turns of the wheel times its known circumference. This information is communicated to a control system which controls the drive rollers 22 to automatically roll out a pre-selected border length. Splice detection rollers 26 are equipped with a sensor 27 which senses relative vertical position of the rollers to detect splices, which is then indicated to the control system. When a splice or any flaw in the border material is detected in this manner, the control system directs the drive rollers 22 to advance the material to bypass the splice or flaw and cut it out of the border, so that a border section of the correct length can be measured that does not include a splice or flaw. The pre-measured border material is thus advanced through the roller pair 22, 24. Alternatively, detection of border material length insufficient to make a complete border can direct the machine to produce two border halves, which can thereafter be assembled into a single border.

Handle material 33 is retained on a separate spool 32, generally aligned with the border material spool and the sewing lane of the apparatus 10. A handle material feed assembly, indicated generally at 34, includes a pair of driver rollers 35, which are controlled by the control system to measure off and advance a predetermined length of handle material. A handle cutter 36, such as a guillotine-type knife, is provided to cut the material 33 to length to produce a handle blank 40, which is attached by stitching to the border material, as further explained herein.

Figure 9:
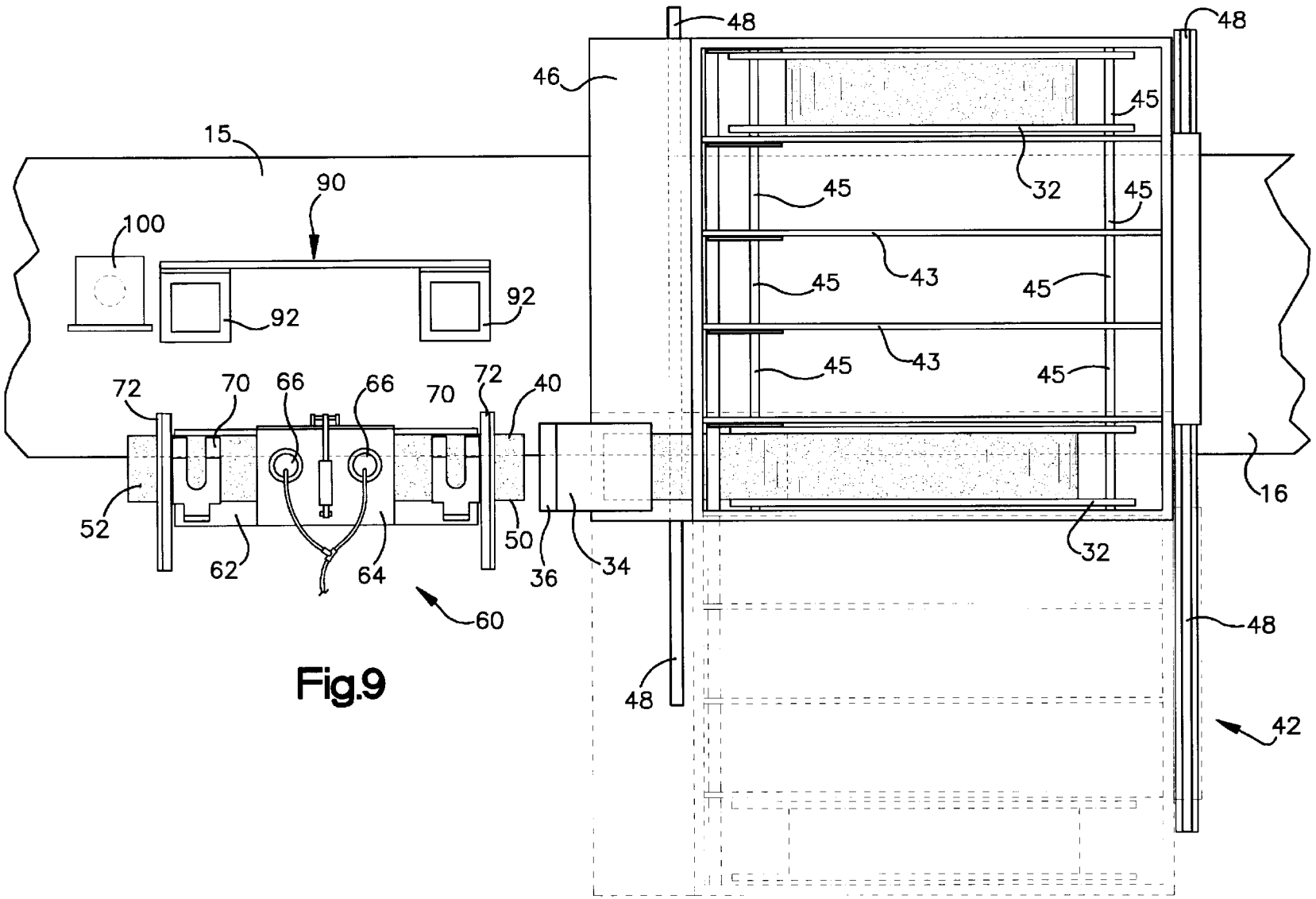
FIG. 9 is a plan view of the handle material magazine, handle folding assembly and double frame handle press of the apparatus of the invention.

As best shown in FIG. 9, in a preferred embodiment one or more handle material spools 32 are supported in a magazine 42 configured with walls 43 on a frame 46 which form multiple channels 44 to support a plurality of spools 32 in a parallel arrangement. Each spool 32 is supported to rotate within a channel 44 on a pair of knurled rollers 45 journalled to rotate between walls 43. The frame 46 is mounted to roll upon transverse rails 48, with a locking pin indexable in holes to fixedly align a selected spool with the handle material feed assembly 34. By this arrangement, multiple handle material spools can be stocked in the machine, and an operator can quickly select, position and feed material from a spool for production of borders to varying specifications.

As further shown in the FIGS., the apparatus includes a handle material folding assembly, indicated generally at 60, which functions to fold the ends of the handle blank 40 and position it upon the border material for attachment by sewing. The handle blank 40 having two ends 50, 52 is discharged from the feed assembly into the folding assembly 60. In certain embodiments, a support arm or handle blank feeder may extend from the handle material feed assembly 34, under the handle blank 40, in order to facilitate transfer of the handle blank 40 from the feed assembly 34 to the folding assembly 60. The folding assembly 60 includes a generally rectangular folding plate 62 about which handle ends 50, 52 are folded. The folding plate 62 is covered by a top plate 64 which aligns and retains the handle blank 40 during folding. Mounted on the top plate 154 are one or more material holding devices 66, such as inflatable diaphragms, operative to extend downward from the top plate 64 to contact the underlying material blank 40 to stabilize it prior to and during the automated folding operation. In a preferred embodiment, the diaphragms 66 are pneumatically actuated rubber bladders, of the type manufactured by Festo Co., but any other type of actuation could be employed (e.g. hydraulic, electromagnetic, etc.) to extend an object downward into contact with the handle blank, any of which are within this conceptual aspect of the invention. In commercial form, a metal disk is attached to the extended end of the bladder. However, in the present invention it has been found that use of the bladders without the metal disk is advantageous for the positive gripping contact the rubber makes with the handle material.

Figure 2:
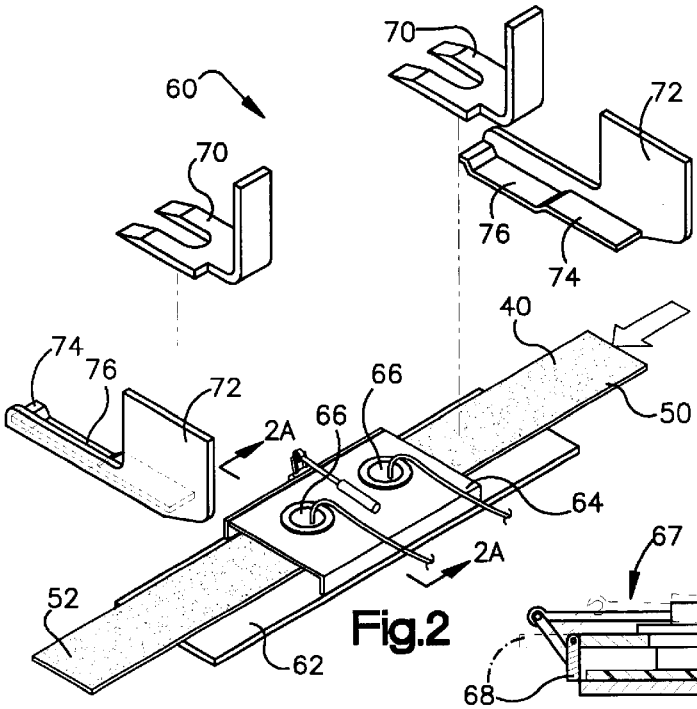
FIGS. 2 and 2A are perspective and end views, respectively, of certain components of a handle folding assembly of the invention.
Figure 2A:
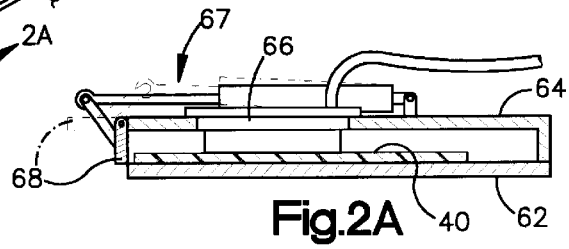
Figure 3:
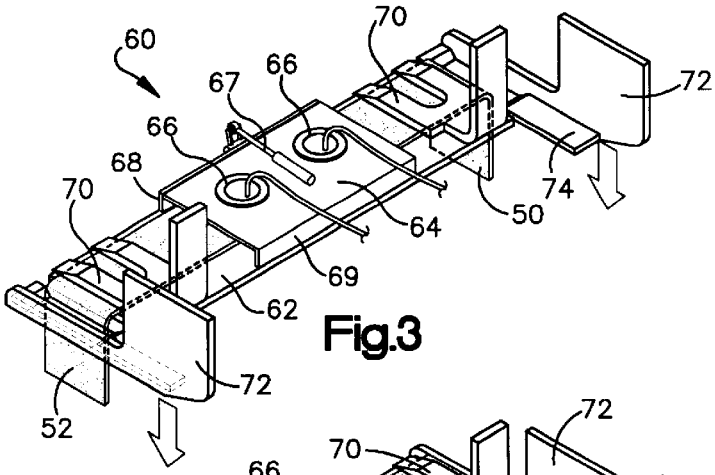
FIGS. 3 and 4 are each perspective views of certain components of a handle folding assembly of the invention.
Figure 4:
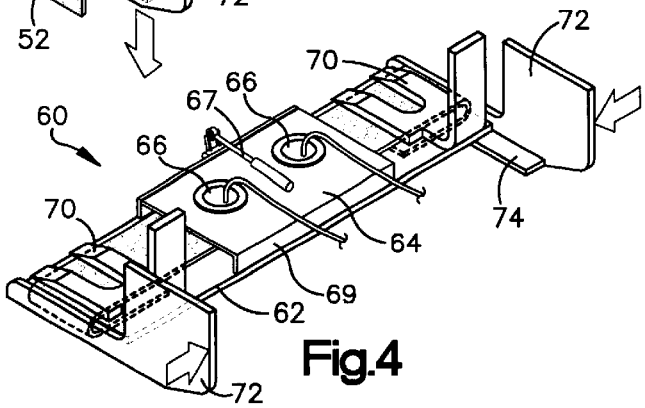

As is best shown in FIG. 2, the folding assembly 60 includes a pair of fork members 70 (also referred to herein as "fold compression devices") which are operatively mounted upon a translation mechanism to vertically descend down upon the handle blank 40 against the folding plate 62 after the blank 40 has been positioned with ends 50 and 52 extending off of the respective ends of the folding plate 62. Although shown in the form of forks, the fold compression devices 70 could be of an alternate configuration suitable to apply pressure to the folded portion of the handle material. After the fork members 70 are in place, folding blades 72, also operatively mounted upon a translation mechanism, vertically descend to downwardly displace the handle ends 50, 52, as shown if FIG. 3. As shown in FIG. 4, the blades 72 are next controlled to converge laterally under opposite ends of the folding plate 62, wrapping the handle ends 50, 52 under the ends of the folding plate 62. The blades 72, each include a lower lip 74 which faces inwardly and slides under the folding plate 62 in order to facilitate the folding of the ends 50, 52. The lower lip 74 further includes a recess 76 for retaining and registering the folded ends in alignment, particularly during removal of the folded handle blank from the folding plate 62, as further described.

Figure 5:
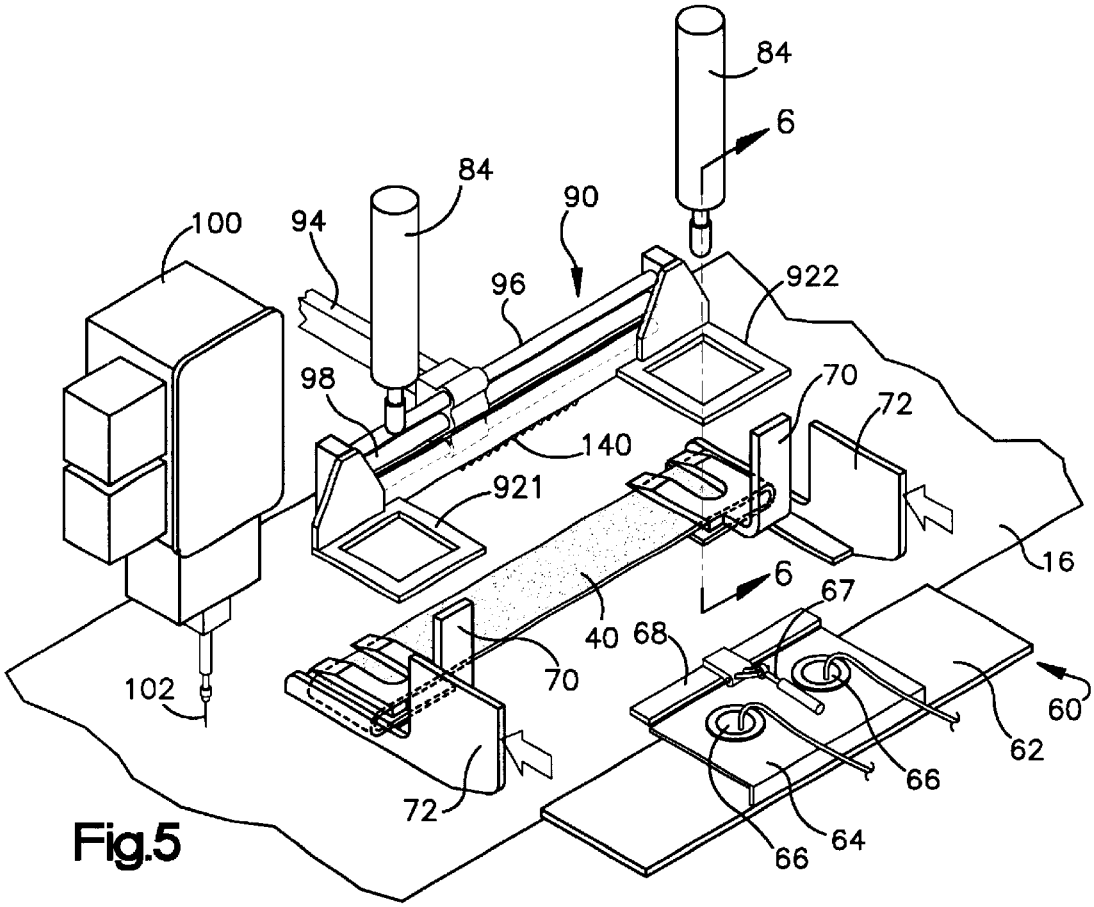
FIGS. 5, 7 and 8 are perspective views of certain components of the handle folding assembly, double frame handle press, sewing head and sewing platform of the apparatus of the present invention.
Figure 6:
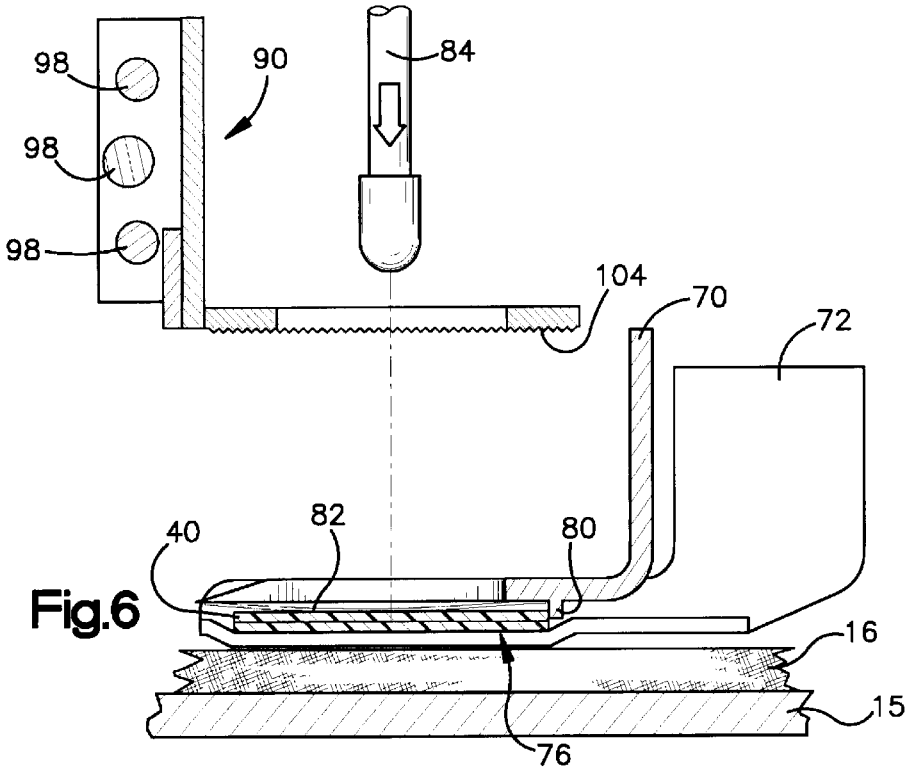
FIG. 6 is a cross-sectional view, taken in the direction of the arrows 6—6 in FIG. 5 of an end segment of the handle folding and double frame handle press of the apparatus of the invention.

After the ends 50, 52 are folded, the folded handle is transferred into position on the border material in the folded condition. As best shown in FIG. 6, the fork members 70 each include on an underside a structure configured to contact an edge of the handle material, for example in the form of a bar 80 that contacts an edge of the folded handle 40. The fork members 70 and the folding blades 72 are laterally displaced carrying the folded handle blank 40 off of the folding plate 62 into position on the border material 16, as shown in FIG. 5. The border material 16 is supported by a sewing platform 15. As shown in FIG. 6, each "tine" of each fork member 70 includes a spring clip 82, such as a leaf-type spring, which applies a biasing force to the folded ends 50, 52 of the handle blank 40, to maintain pressure on the folded ends during the transfer operation as the handle is slid off of the folding plate 62 to the side. The top plate 64 includes a side door 68 that opens to allow the handle blank 40 to be removed from the folding plate 62 to the side. A piston actuator 67 (as shown) or any other equivalent structure can be used to actuate the side door 68. An opposing side wall 69 can also be provided to extend from the folding plate 62 to the top plate 64.

Figure 7:
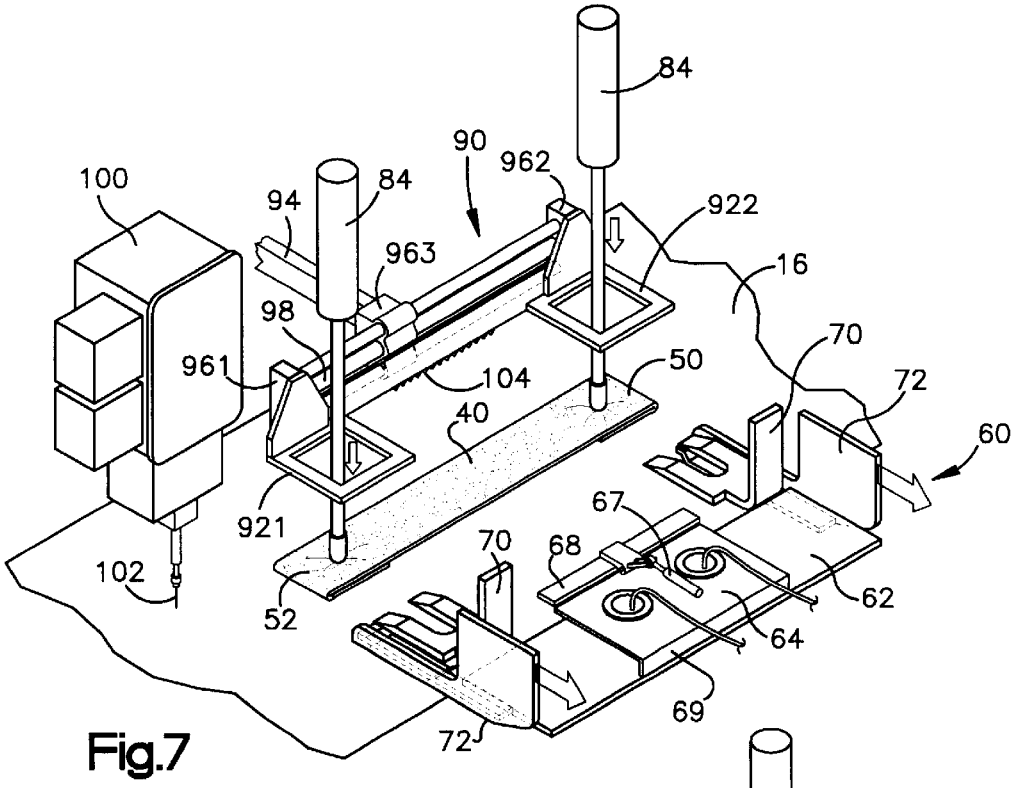
Figure 8:
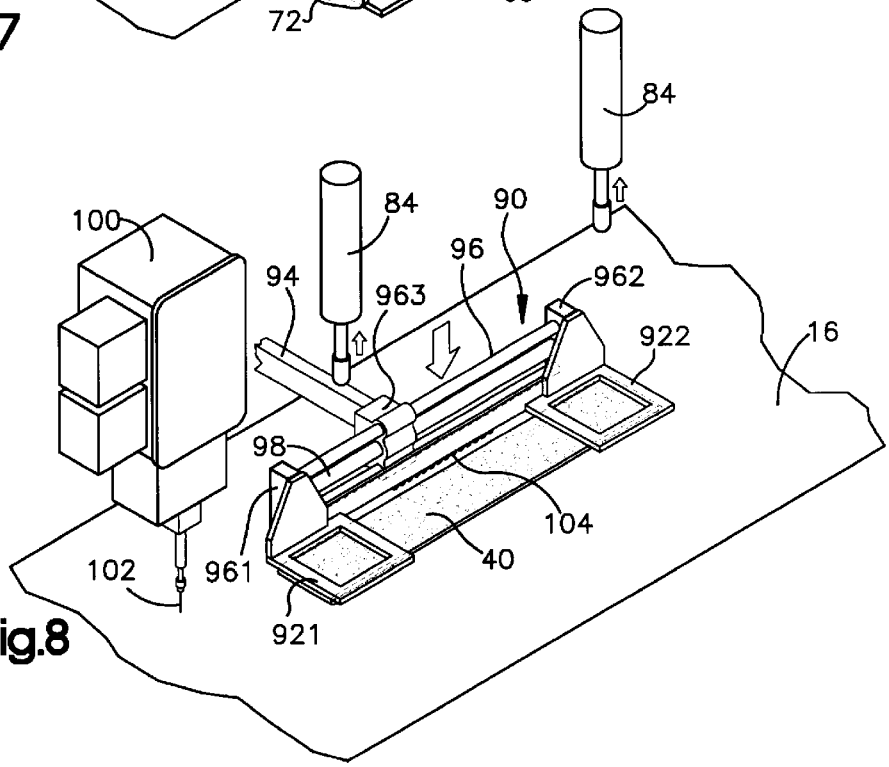

As shown in FIGS. 6 and 7, when the handle blank 40 is thus positioned over the border material, a pair of vertical cylinder rods 84 are actuated to extend down on the folded ends 50, 52. The fork members 70 include an opening between the "tines" to admit the cylinder rods 84. When the cylinder rods 84 are in place, the fork members 70 and the folding blades 72 retract, leaving the handle blank 40 in its proper position on the border material, as shown in FIG. 7. As shown in FIGS. 7 and 8, the cylinder rods 84 are vertically displaced between retracted and holding positions. The cylinders 84 are preferably pneumatically actuated, and can self-compensate for different thicknesses of handle material.

As shown in FIGS. 7 and 8, after the fork members 70 and folding blades 72 retract, a double frame handle press 90 vertically descends to press the folded ends 50, 52 of the handle blank 40 on to the border material 16. The double frame handle press 90 preferably includes a pair of generally square frames 921, 922 for pressing down upon the perimeter regions of the respective folded ends 50, 52. The vertical motion of the double frame handle press can be accomplished by connection to the clamp mechanism incorporated into the Mitsubishi PLK-B1006 series commercial sewing machine, which is an example of one type of sewing machine with which the invention can be practiced. As shown in FIG. 7, the cylinder rods 84 pass through the openings in the respective frames 921, 922 of the double frame handle press 90. When the double frame handle press 90 is securely in place, the cylinder rods 84 retract, as shown in FIG. 8, thus leaving the folded handle ends freely exposed within the frames 921,922 for application of a stitch pattern by a sewing needle.

The double frame handle press 90 is connected to an X-Y carriage assembly (not shown) via strut 94. The X-Y carriage assembly is incorporated into the sewing machine, such as the Mitsubishi PL-B1006, and is operative to move any assembly connected to it (via strut 94) in a program-controlled pattern under a sewing needle 102 which extends from a sewing head 100. For example, one type of programmed stitch pattern may be a box stitch placed within the each frame 921, 922 through the handle and underlying border material.

The double frame handle press 90 is mounted to a rodless magnetically coupled translation device, indicated generally at 96, such as a Bimba Ultran rodless cylinder assembly. The device 96 includes first and second blocks 961 and 962 attached respectively to frames 921 and 922, and a central block 963 fixed relative to strut 94. The blocks 961 and 962 are connected by three rods, one of which is pneumatically charged, and magnetically coupled. When pneumatically actuated, block 962 is forced toward and into contact with block 963, thus translating the double frame handle press to position frame 922 where frame 921 was previously located. By this arrangement, only the double frame handle press 90 is moved to position frame 922 under the sewing needle, thus avoiding the need to increase the amount of travel of the X-Y carriage assembly of the sewing machine, and eliminating the need for the entire X-Y carriage assembly to repeatedly traverse the range between the two frames.

The double frame handle press 90 is further equipped with a material engagement surface, such as material engagement teeth 104, as shown in FIG. 8, which may be located on either one of the frames or on a connecting member 93 which extends between the frames. The engagement teeth 104 function to grip the border material to move it in unison with the handle material through the X-Y sew pattern and along with the motion of the translation device 96. Alternatively, the material engagement surface of the double frame handle press 90 may contact the handle material, or both the handle material and border material.

Figure 10:
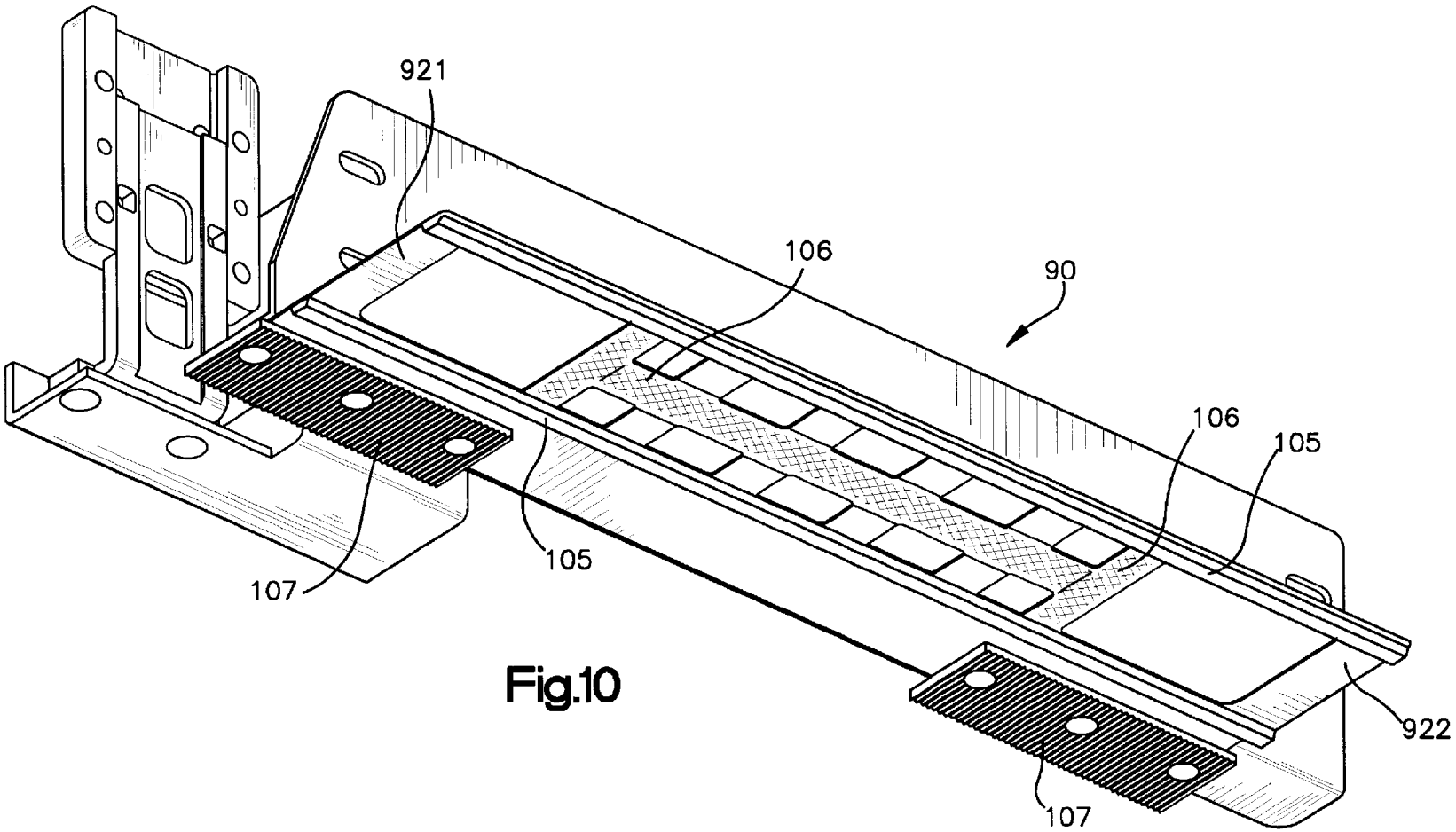
FIG. 10 is an isolated view of a preferred embodiment of the double frame handle press component of the apparatus of the invention.

FIG. 10 illustrates a preferred embodiment of the double frame handle press 90 which includes laterally opposed side rails 105 which run substantially the length of the press to define a channel in which the handle 40 is positioned and squarely registered. High friction tape 106 or other frictional surface coating is applied to the underside surface of the press structure between the frames 921 and 922 to fractionally engage the handle. Border clamping pads 107 are provided proximate to frames 921, 922 to fractionally engage the border material for the described lateral transfer. Also, the end sections 921*e* and 922*e* can be eliminated from the double frame handle press to avoid any potential interference with the folded ends of the handle when the handle press is retracted upward as described. The border clamping pads 107 can be mounted in an articulated manner, such as with one or more spring members, to achieve positive engagement with the border material, which due to quilting does not have a smooth or even surface.

After the handle 40 has been'securely attached to the border material 16, the finished border piece is advanced by drive rollers 110. Afterwards, the border is cut to length with a guillotine-type cutter 112, in which an excess splice section is automatically accounted for by the control system.

The apparatus of the invention further includes a device for installation of one or more vents into the border material 16. Shown as item 105 in FIG. 1, the vent installation module can be located downstream of the sewing head 100, or at any other suitable location in this process stream. It is operative to install vents generally in the form of a grommet, having a displaceable frame or rim surrounding a screened opening which allows air to pass through the border. The vent module 105 includes a magazine fall of vents which are loaded singularly into a punch which drives the vent into the cross-section of the border material, removing the same amount of material, and securing the vent to the surrounding material. The number and location of vents is if set by control of the vent module in synchronization with the border manufacture process steps.

Also, the number and location of handles attached to the border material is set by configuration of a system controller which governs the operation, sequencing and synchronization of each operation of the apparatus. For example, eight or more handles could be symmetrically or asymmetrically attached by the use of modified software which controls the timing of material fee, handle cutting, handle folding and transfer, etc.

Figure 11:
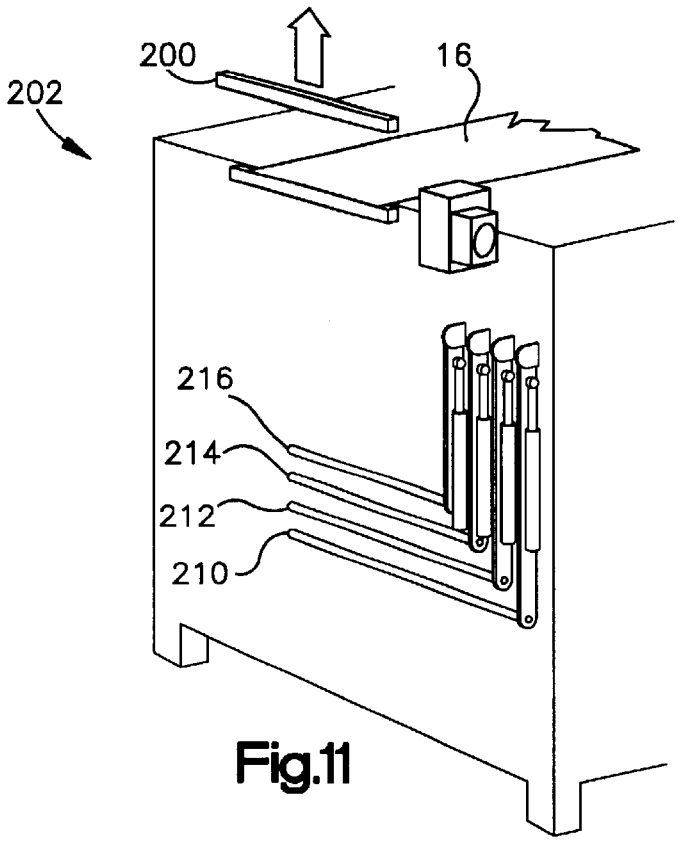
FIGS. 11–23 are various views depicting folding, closing, labeling, wrapping, and stacking modules, according to additional aspects of the invention.
Figure 12:
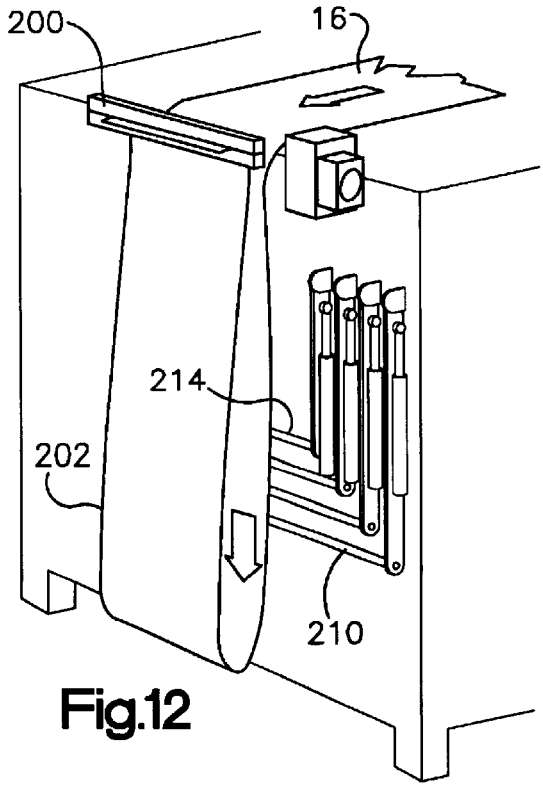
Figure 13:
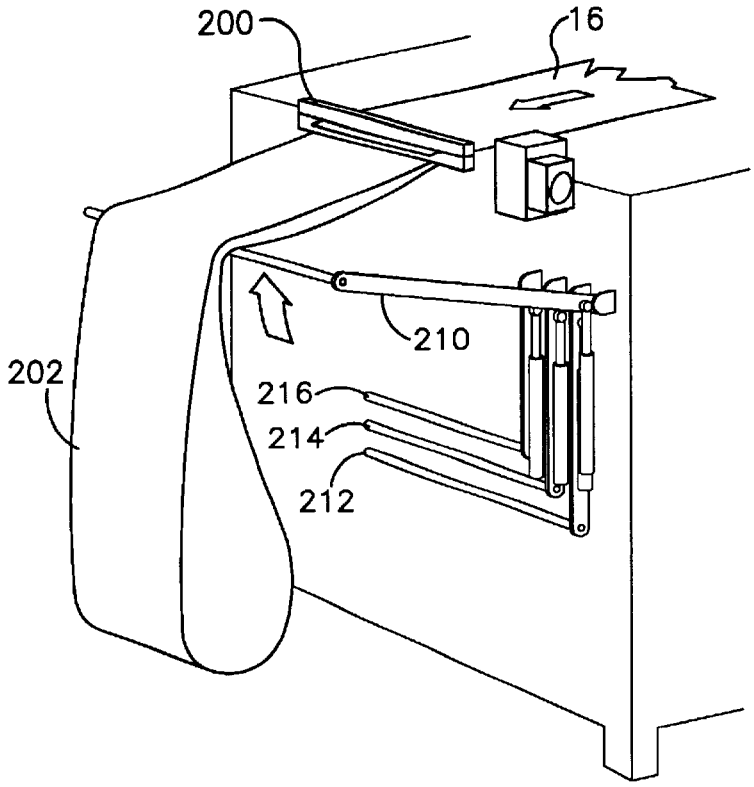
Figure 14:
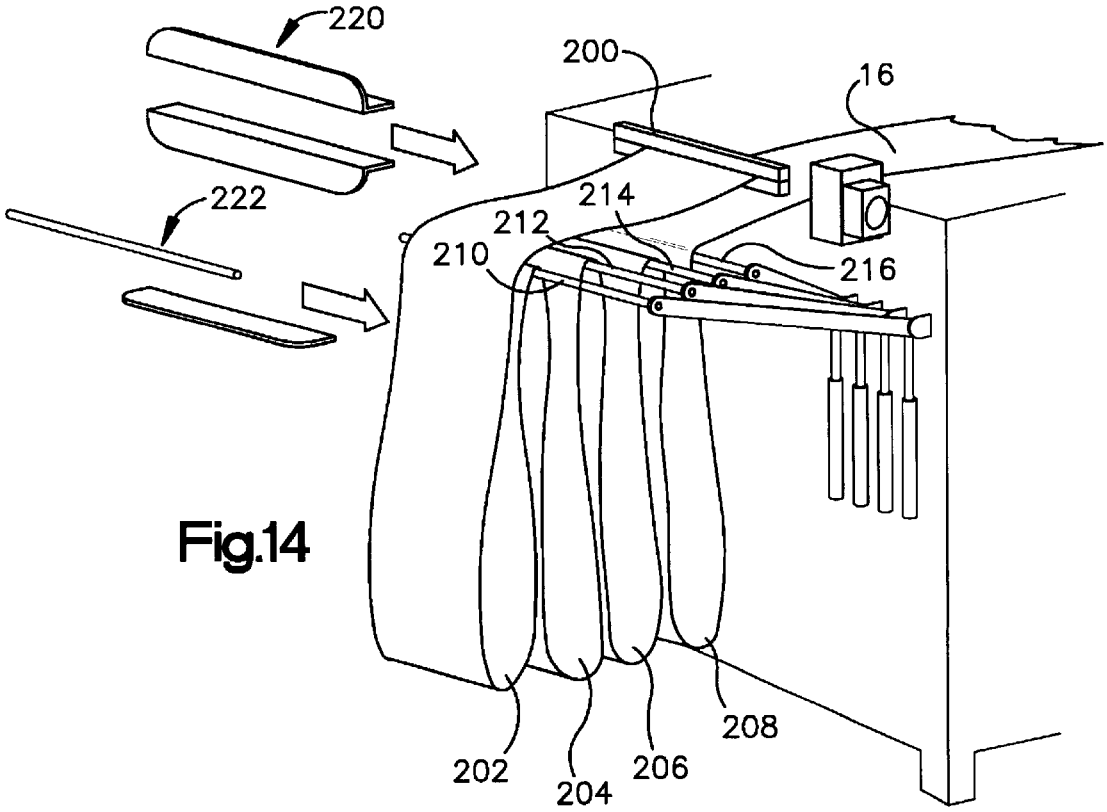

Another aspect of the invention is shown in FIGS. 11–23. After handle attachment, the border piece 16 is closed and wrapped for shipping in a manner disclosed hereinbelow. As shown in FIG. 11, the border piece 16 is advanced into a "folding module" 201 so that a leading edge of the border piece 16 extends between the jaws of a first clamp 200. The jaws close and the leading edge is thereby clamped and retained by the first clamp 200. As shown in FIG. 12, the border piece 16 is further advanced so that a first loop of material 202 hangs down, the first loop 202 being advanced by such an amount as to have a predetermined length. As shown in FIG. 13, a first folding arm 210 is actuated to swing upwards and lift the first loop 202 in a folding operation. Afterwards, the border 16 is advanced to produce a second loop of material 204. The folding arms 210, 212, 214, 216 are best shown in FIG. 11, and are preferably driven by hydraulic actuators. As shown in FIG. 14, after the second loop 204 is advanced, the second folding arm 212 swings upwards to lift the second loop 204. The border 16 is fed out to produce a third loop 206 that is lifted by the third folding arm 214. A fourth loop 208 is advanced and is lifted by the fourth folding arm 216. It should be appreciated that the respective loops are fed out so as to allow a finished border product having a desired predetermined length.

Figure 15:
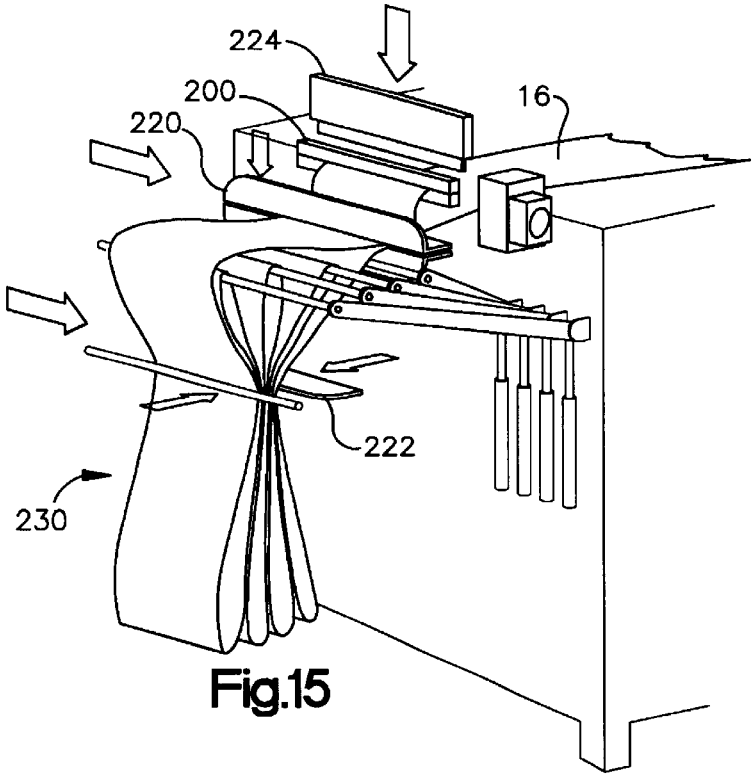
Figure 16:
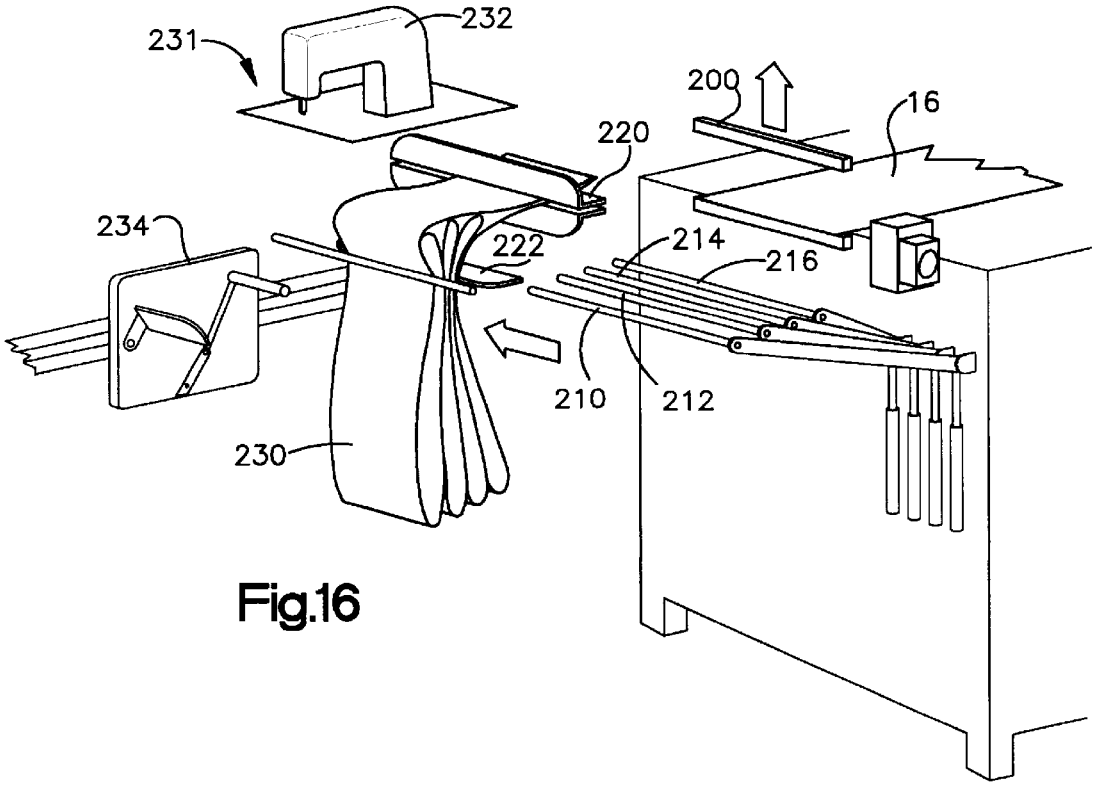
Figure 17:
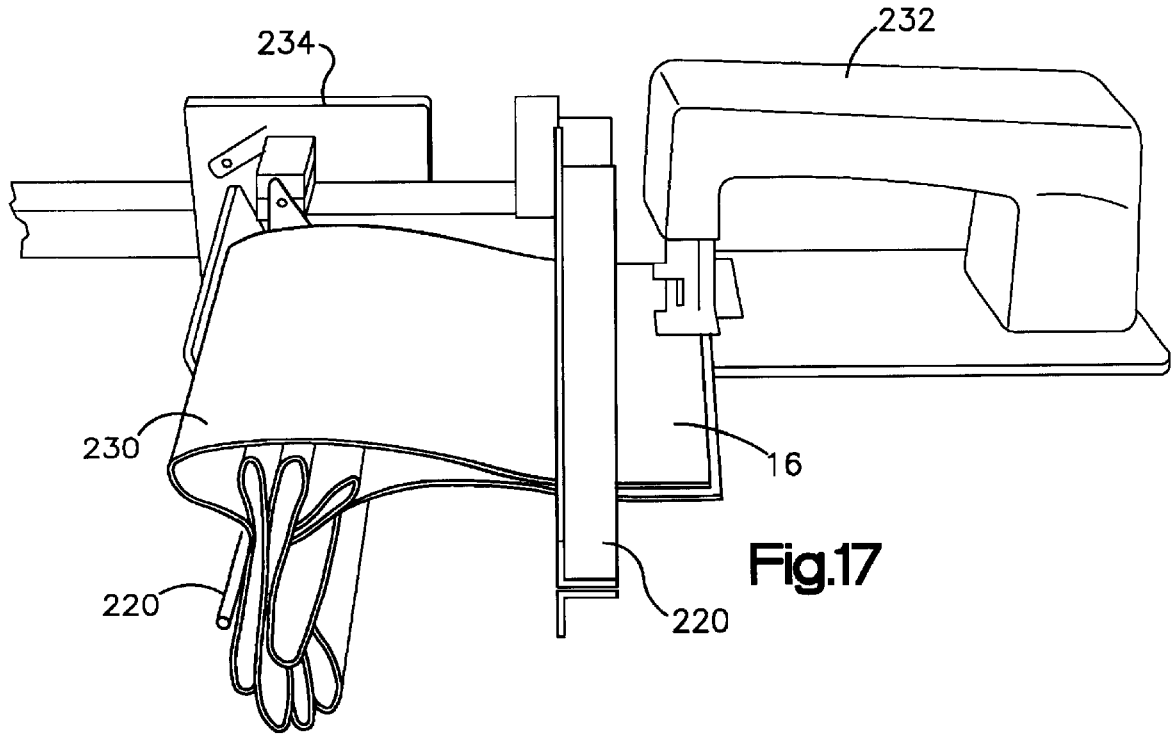

After folding the loops 202, 204, 206, 208, a second clamp 220 is advanced laterally on to the loops, as shown in FIG. 14. A third clamp 222, shown in FIG. 15, is moved into position to grasp and clamp the loops 202, 204, 206, 208. As shown in FIG. 15, the jaws of the second and third clamps 220, 222 close around the loops of material. A guillotine knife 224 descends to cut the trailing edge of the border material 16, resulting in a folded bundle 230 of border material in the form of a finished mattress border. As shown in FIG. 16, the second and third clamps 220, 222 then retract, moving the bundle 230 from the folding arms 210, 212, 214, 216 to a "closing module" 231 where it is brought into contact with a sewing head or "closer" 232 and also in between the jaws of a transfer clamp 234. As best shown in FIG. 17, the second clamp 220 holds together the cut ends of the border as the bundle 230 is moved laterally relative to the closer 232, to produce a closed border, i.e., the ends of the border material 16 sewn together. The second and third clamps 220, 224 are supported and displaced by a sew carriage (not shown) that can be belt-driven to allow reciprocating lateral motion between the folding module and the closing module, for moving the bundle 232. It should be appreciated that the closer 232 can alternatively be displaced to close the ends while the bundle 232 is held stationary, without departing from the invention.

Figure 18:
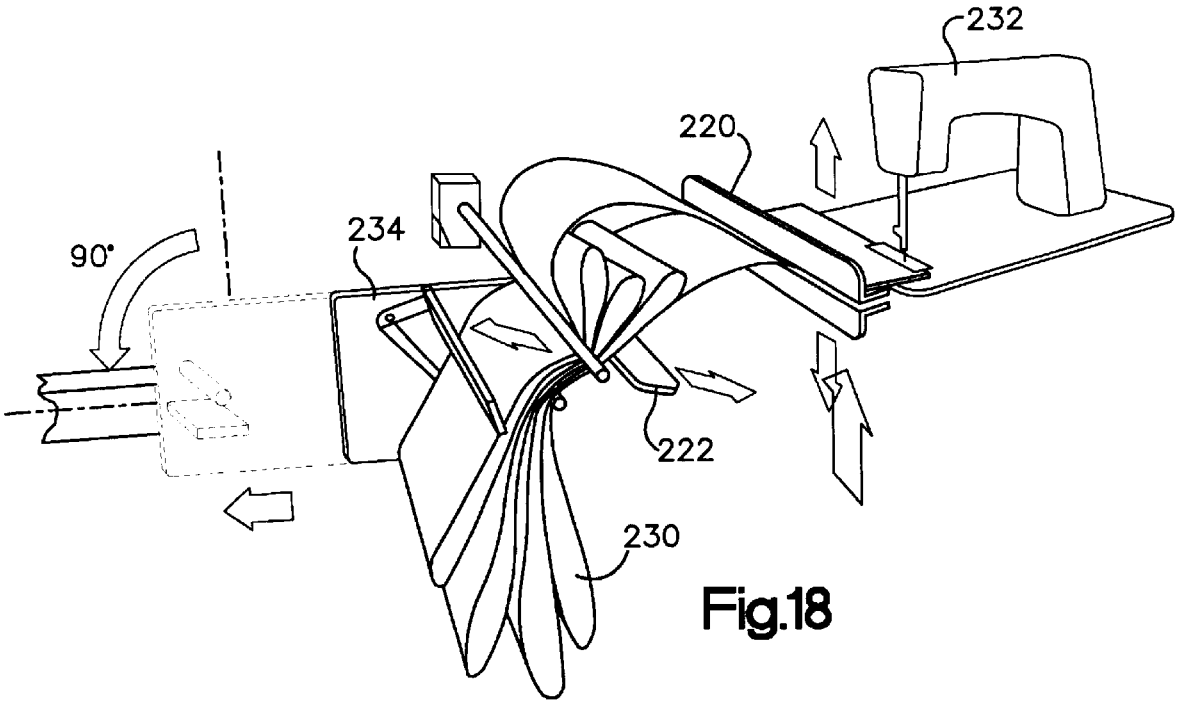

As shown in FIG. 18, after closing the ends of the bundle 232, the jaws of the transfer clamp 234 are closed and the jaws of the second and third clamps 220, 222 are opened to release the closed bundle 230 to the transfer clamp 234. The transfer clamp 234 then displaces the bundle 230 from the closing module to a "labeling module" 241, FIG. 19. During transfer of the bundle 230, the jaws of the transfer clamp 234 are rotated 90 degrees so that the bundle 230 will be in position for labeling.

Figure 19:
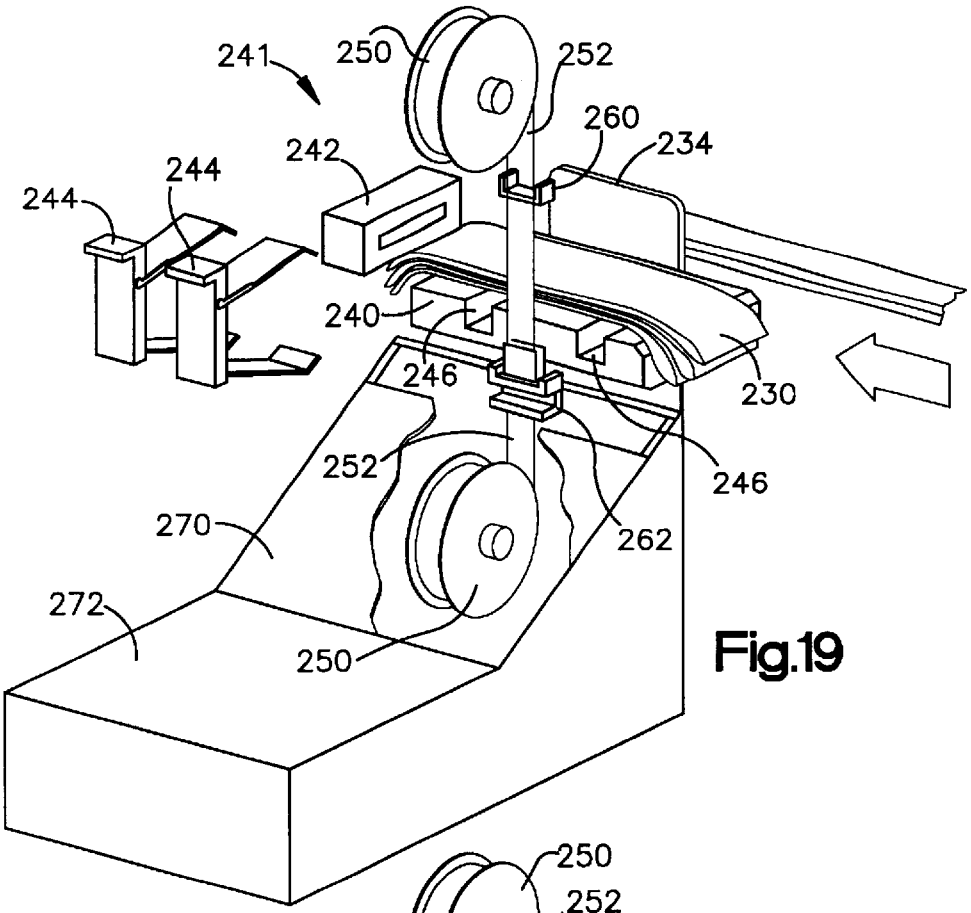
Figure 20:
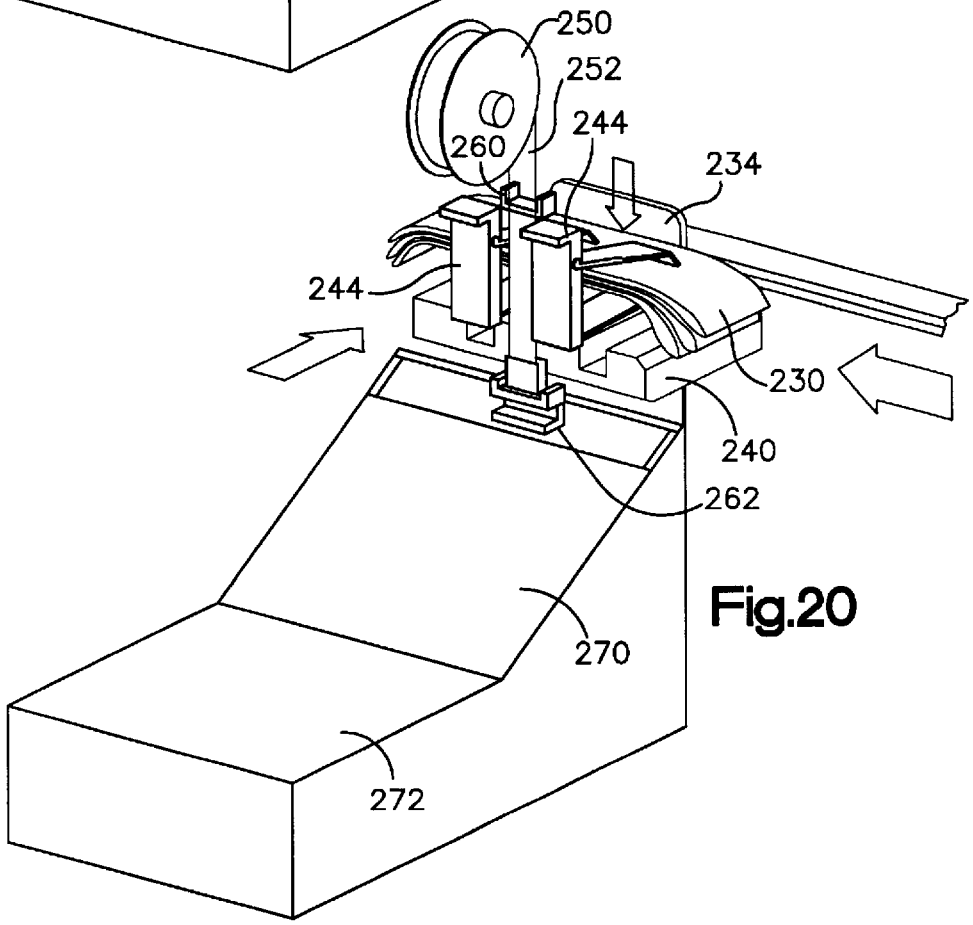
Figure 21:
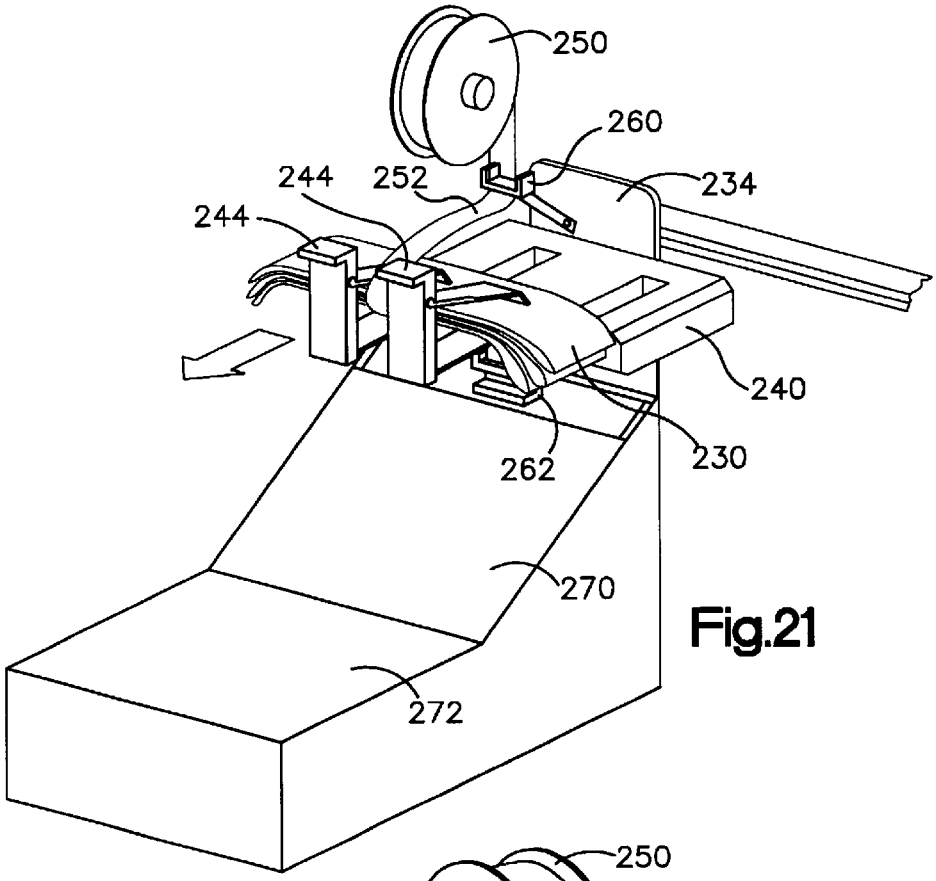

As shown in FIG. 19, the bundle 230 is moved to the labeling module 241 which includes a table 240 and a labeler 242. A pair of stacker clamps 244 each having a pair of jaws are moved into place to clamp the folded border, as shown in FIG. 20. The table 240 includes a pair of openings 246 for receiving the stacker clamps 244 and allowing them to gain access to the bottom of the bundle 230 while clamping. As best shown in FIG. 19, a pair of tape spools 250 are part of a "wrapping module" and disposed respectively above and below the bundle 230, for dispensing a plastic wrapping tape 252. The stacking clamps 244 are on either side of the tape 252 so as to not interfere with the tape 252 while moving into table 240 to grasp the bundle 230, as shown in FIG. 20. As shown in FIG. 21, the stacker clamps 244 withdraw the bundle 230 from the table 240, thereby pulling the bundle 230 across a section of tape 252.

The labeler 242 includes a printing head for printing desired information on the bundle 230, and printing occurs as the bundle 230 is withdrawn by the stacking clamps 244. The desired printed information can be any identifying information for the particular bundle, e.g., 15-characters or more, and can indicate the size and style of the bed, and any other type of information.

Figure 22:
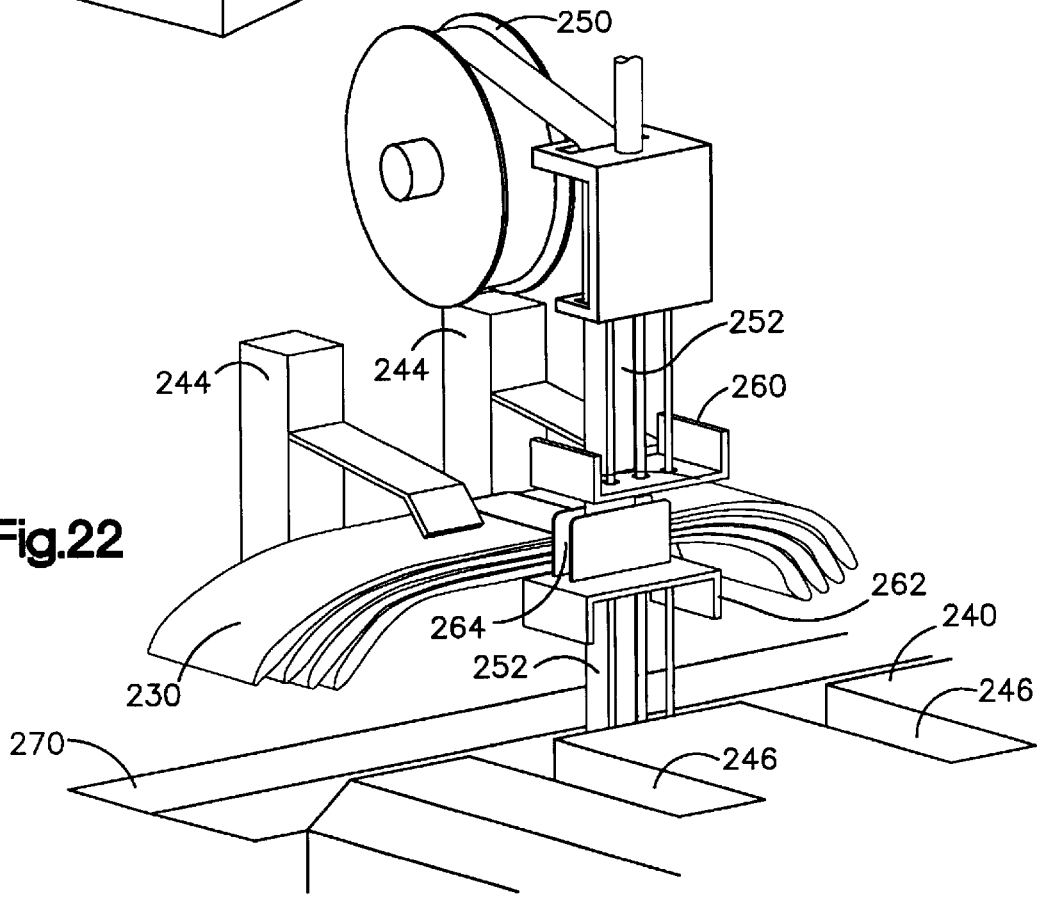

As best shown the FIG. 22, the wrapping module includes a pair of wrapping jaws 260, 262 for wrapping the bundle 230 with tape 252. As the bundle 230 is withdrawn by the stacker clamps 244, the wrapping jaws 260, 262 close at the edge of the bundle 230. Each wrapping jaw 260, 262 includes a central opening for allowing the tape 252 to pass through from each respective tape spool 250. The upper wrapping jaw 260 is in this embodiment simply a mandrel that holds the tape in place. The lower wrapping jaw 262 is a mandrel that includes a heating element 264 for heat sealing the tape 252 at the edge of the bundle 230, thereby sealing and cutting the tape 252 free from the bundle. The heating element 264 also fuses together the ends of the tape 252 from the respective spools 250, thereby producing a continuous tape strip that is ready for the next bundle.

Figure 23:
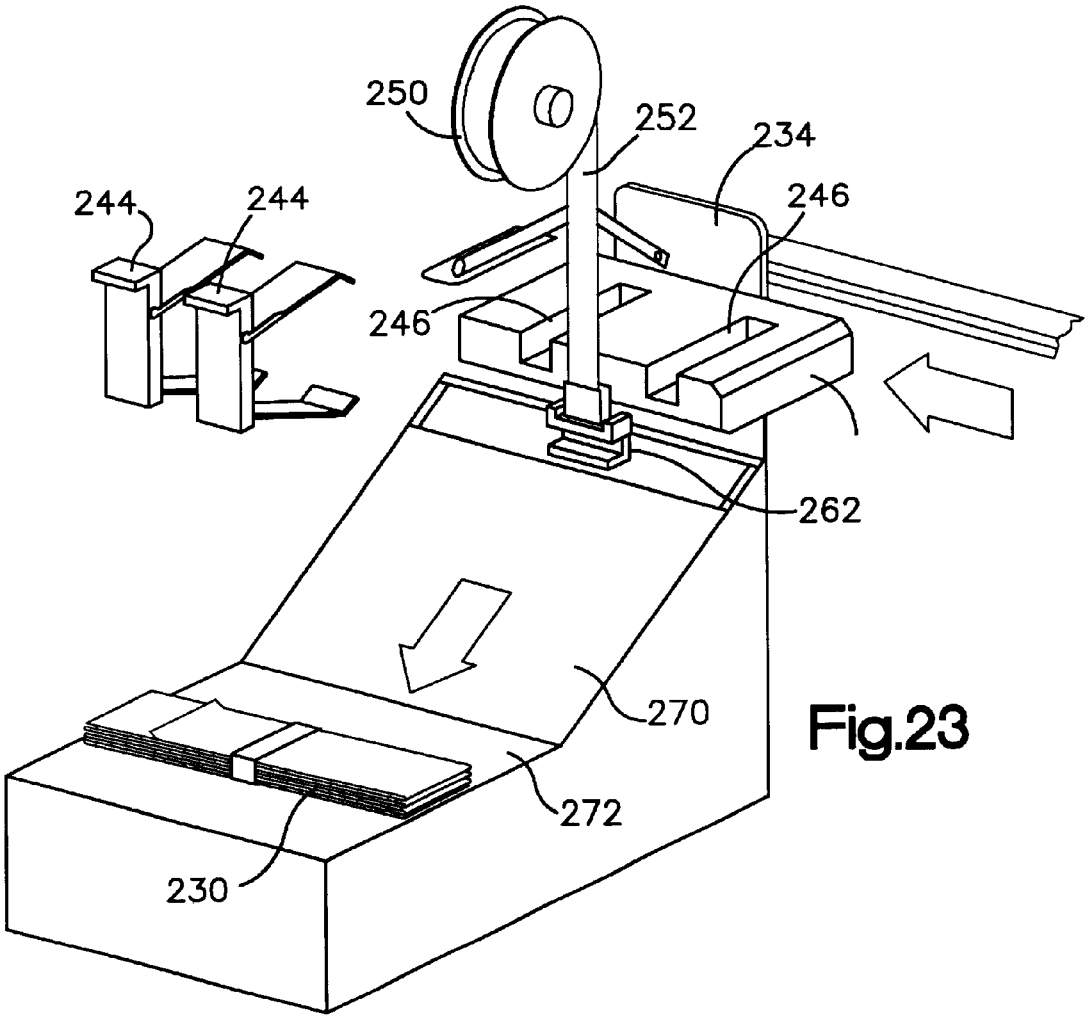

As shown in FIG. 23, after wrapping, the stacking clamps 244 open to release the bundle 230 to a "stacking module," where the bundle 230 is allowed to slide down a slope 270 to a stacking tray 272, where it can be retrieved for further handling. In this manner, the finished border product is secured for subsequent transfer to the next step in the manufacturing operation, allowing neatness in handling and stackability, resulting in efficient process operation.

Each of the various described functions of the machine, as performed by pneumatic, hydraulic or electric actuation mechanisms, are controllable by a digital process controller. The controlled parameters include operation of the border material pre-feeder and associated encoder for length measurement and splice detection; secondary encoded length measurement for handle placement; handle material feed drive and cutting and operation of the handle feeder; operation of the handle folding assembly, and operation of the primary border drive rollers and cutter. A separate interfaced controller may be used for operation of the X-Y carriage assembly of the sewing machine to which the double frame handle press is attached, and for operation of the sewing machine.

Other control functions which can be implemented in accordance with the invention include menus for inputting border style designations based upon the type of border material to be used. Known stretch factors of selected materials are stored in the control system and compensated for in the material advancement and handle placement signals to the process drive components. Also, in the operation of the border material pre-feeder, detection of a length of border material insufficient to produce a complete continuous border will prompt the machine to produce two border halves. The controller can be operated by a touch screen which displays a menu of input options pertaining to the number and size of borders to be produced, style designation, number and placement of handles, and stitch pattern. These and other control features can be incorporated to provide a system which produces a wide variety of borders with minimal set-up change to the machinery.

Although described with reference to the automated production of mattress borders, the various principles and concepts of the invention are of course applicable to other types of automated sewing and material handling operations. It is also understood that various changes in the details, materials and arrangements of parts which have been herein described and illustrated may be made by those skilled in the art are within the scope of the invention, as defined by the accompanying claims and equivalents thereof.

What is claimed as the invention is:

1. An apparatus comprising:

a material feed mechanism for feeding a fabric material;

a folding module for folding a predetermined length of material from the feed mechanism to produce a folded bundle of material;

a closing module for securing two ends of the predetermined length; and a wrapping module for applying a wrapping to the folded bundle.

2. The apparatus of claim 1 wherein the folding module comprises a first clamp having jaws that close over a leading edge of the material to thereby clamp and retain the leading edge.

3. The apparatus of claim 1 wherein the predetermined length of material is at least one loop of material and wherein the folding module comprises at least one folding arm for lifting the loop in a folding operation.

4. The apparatus of claim 3 wherein the at least one loop comprises a plurality of loops and wherein the at least one folding arm comprises a respective plurality of folding arms, for lifting each respective loop in the folding operation, so as to produce a folded bundle with a respective plurality of loops.

5. The apparatus of claim 1 further comprising a second clamp and a third clamp for grasping and clamping the folded bundle for transfer of the bundle to the closing module.

6. The apparatus of claim 5 wherein at least of the second clamp and third clamp holds together the two ends as the folded bundle is moved through the closing module, to produce a closed predetermined length of material.

7. The apparatus of claim 1 further comprising a guillotine knife for cutting the trailing edge of the material to the predetermined length.

8. The apparatus of claim 1 wherein the closing module comprises a sewing head.

9. The apparatus of claim 1 further comprising a labeling module for labeling the folded bundle.

10. The apparatus of claim 1 further comprising a transfer clamp for displacing the bundle from the closing module to the labeling module.

11. The apparatus of claim 10 wherein the labeler includes a printing head for printing desired information on the bundle.

12. The apparatus of claim 1 wherein the wrapping means further comprises:

at least one tape spool for dispensing a plastic wrapping tape;

at least one stacker clamp having a pair of jaws for clamping the folded bundle and drawing the bundle across the tape;

sealing means for sealing the tape around the bundle.

13. The apparatus of claim 12 wherein the at least one stacker clamp comprises a pair of stacking clamps on either side of the tape so as to not interfere with the tape while grasping the bundle.

14. The apparatus of claim 13 wherein the wrapping module comprises a table for receiving the bundle prior to wrapping and wherein the table includes a pair of openings for receiving the stacker clamps and allowing them to gain access to the bottom of the bundle while clamping.

15. The apparatus of claim 12 wherein the at least one tape spool comprises a pair of tape spools disposed respectively above and below the bundle for each dispensing the plastic tape.

16. The apparatus of claim 15 wherein the securing means comprises an upper wrapping jaw and a lower wrapping jaw wherein at least one of the upper and lower jaws comprise a sealing and cutting means for sealing and cutting the tape at the edge of the bundle, thereby producing a continuous tape strip that is ready for the next bundle.

17. The apparatus of claim 16 wherein the sealing and cutting means comprises a heating element for heat sealing the tape and thereby effectively cutting the tape free from the bundle, and fusing together the ends of the tape from the respective spools to thereby produce the continuous tape strip.

18. The apparatus of claim 1 further comprising a stacking module for receiving the folded bundle after wrapping.

19. The apparatus of claim 18 wherein the stacking module comprises a stacking tray a for receiving the bundle for further handling.

* * * * *